US008038587B2

(12) United States Patent
Heck

(10) Patent No.: US 8,038,587 B2
(45) Date of Patent: Oct. 18, 2011

(54) MASSAGE AND RESISTANCE TRAINING METHOD

(76) Inventor: Robert Walter Heck, Park City, UT (US)

( * ) Notice: Subject to any disclaimer, the term of this patent is extended or adjusted under 35 U.S.C. 154(b) by 387 days.

(21) Appl. No.: 12/117,402

(22) Filed: May 8, 2008

(65) Prior Publication Data

US 2008/0269029 A1 Oct. 30, 2008

Related U.S. Application Data

(63) Continuation-in-part of application No. 10/895,637, filed on Jul. 20, 2004, now Pat. No. 7,416,519.

(51) Int. Cl.
*A63B 21/04* (2006.01)

(52) U.S. Cl. ..... 482/129; 601/71

(58) Field of Classification Search ..... 482/43, 482/51, 54, 62, 63, 129, 148, 121, 122, 124, 482/130; 601/11, 23, 24, 26, 46, 71, 79, 601/81, 143, 144, 145, 146, 147
See application file for complete search history.

(56) References Cited

U.S. PATENT DOCUMENTS

| | | | | |
|---|---|---|---|---|
| 1,250,118 | A | 12/1917 | Flynt | |
| 1,507,554 | A | 9/1924 | Cooper | |
| 1,702,991 | A | 2/1929 | Bechmann | |
| 1,730,687 | A | 10/1929 | Riley | |
| 1,747,372 | A | 2/1930 | Luehrmann | |
| 1,758,663 | A * | 5/1930 | Hendry | 601/144 |
| 1,783,171 | A * | 11/1930 | Knott | 601/145 |
| 1,793,214 | A | 2/1931 | Dyer | |
| 1,805,853 | A | 5/1931 | Smith | |
| 1,807,308 | A | 5/1931 | DeRemer | |
| 1,919,062 | A * | 7/1933 | Haynes | 601/143 |
| 2,980,109 | A * | 4/1961 | Schein | 601/145 |
| 3,344,783 | A * | 10/1967 | Stoll | 601/145 |
| 3,915,159 | A | 10/1975 | Simjian | |
| 3,921,625 | A * | 11/1975 | Feather | 601/144 |
| 3,960,144 | A | 6/1976 | Simjian | |
| 4,991,568 | A | 2/1991 | Lin | |
| 5,158,075 | A | 10/1992 | Howard | |
| 5,192,257 | A | 3/1993 | Panasewicz | |
| 5,234,392 | A | 8/1993 | Clark | |
| 5,609,566 | A | 3/1997 | Pupovic | |
| 6,383,154 | B1 | 5/2002 | Chang | |
| 6,443,876 | B1 * | 9/2002 | Huang | 482/54 |
| 6,758,792 | B1 * | 7/2004 | Chang | 482/54 |
| 7,087,029 | B2 | 8/2006 | Friedland | |
| 2009/0197741 | A1 * | 8/2009 | Poillucci et al. | 482/44 |

* cited by examiner

*Primary Examiner* — Loan Thanh
*Assistant Examiner* — Tam Nguyen
(74) *Attorney, Agent, or Firm* — Thorpe North & Western LLP

(57) ABSTRACT

A resistance training and massage method simultaneously provides resistance training and massage. A vibrating strap is formed into a loop to extend around a body portion of a user. The strap is displaceable as the user exerts a pulling force on the strap. A motor is coupled to the strap and displaceable along with the strap as the user exerts a pulling force on the strap. The motor imparts vibration to the strap. Resistance means is coupled to the motor for elastically resisting displacement of the motor and the strap, and providing a resistance force to the pulling force exerted by the user.

19 Claims, 9 Drawing Sheets

MASSAGE AND RESISTANCE TRAINING METHOD

PRIORITY CLAIM

This is a Continuation-In-Part application of U.S. patent application Ser. No. 10/895,637 filed on Jul. 20, 2004, U.S. Pat. No. 7,416,519 which is herein incorporated by reference.

BACKGROUND OF THE INVENTION

1. Field of the Invention

The present invention relates generally to resistance training and cellulite reduction.

2. Related Art

Fat deposition on the back, thighs, buttocks, and abdomen often has a dimpled appearance. This type of fat has been coined "cellulite," and has been a cosmetic challenge for both heavy and thin people for decades. Scientists, doctors, and entrepreneurs around the world have been trying to develop a solution for years.

Millions of research, development and consumer dollars have been spent on various creams and lotions purported to dissolve cellulite. The scientific support for and the results from studies on these products are often lacking, but the public continues to purchase them. Often, misleading information from the manufacturers and ignorance on the part of consumers leads to poor results and discontent. Marketers attempt to convince the public that their product works. But what they fail to disclose is that the user must apply this cream or lotion daily, and do so using deep massage.

There may be a valid reason why these creams or lotions work well for some, and not at all for others. The trick and secret may have to do with the method of application, and not necessarily the make up of the cream or lotion. If the cream or lotion is applied in the normal fashion of a lotion, with light pressure, the results are likely to be poor. There may be some increase of circulation to the skin caused by the product itself, but it is unlikely to permeate the fat cells. Thus, one should not expect any alteration in the fat that lies deep below the skin. If, however, the cream is applied with deep massage, more blood will be summoned to the skin, subcutaneous tissue, and fat layer. The increase in circulation caused by massage actually helps to mobilize fatty cells which could potentially "spot reduce" fat. Further, deep massage can mechanically break down the septations between the fatty pockets in cellulite. These fatty pockets are what cause the dimpled appearance of cellulite. Liposuction is a surgical procedure for spot reduction of fat. Liposuction not only mechanically removes fat globules, but also breaks down the septations which surround the fatty globules. Unfortunately, this procedure is not only very painful, but fraught with potential complications. Scarring can occur from the incisions and adhesion within the fatty layer, thus worsening, rather than improving the look of the fatty area. In addition, this procedure is very operator dependent. Therefore, results can vary significantly.

There are three proven methods known to eliminate cellulite which are safe, non-invasive, and effective—diet, exercise, and massage. Almost any diet can be used as long as the end result is a decrease in the total amount of body fat. By decreasing the total body fat, one can decrease the amount of cellulite. Since the fat should not and cannot be completely removed and the septations remain intact, this method just reduces the volume of cellulite. Once the weight is added back on, the cellulite puckers up again. Fat reduction alone, through diet and exercise can eliminate approximately 90% of the problem. The remaining 10%, and the reason that some "skinny" people still have cellulite, can be due to septations. A certain amount of body fat is healthy, and losing the extra 10% may require many people to take extreme and unhealthy measures to completely eliminate cellulite. Not only would it be unhealthy, but it can require prolonged discipline that can take the joy out of life, and can be difficult to sustain long term.

Exercise also helps in the elimination of cellulite. Exercise can increase the number of calories burned, which decreases further deposition of fat. The only way to reduce pre-existing fat is to run a calorie deficit. This means that a person must burn more calories than he or she has available for fuel. Fat is only broken down to provide the extra calories needed when there is not enough food in the digestive tract.

Progressive resistance training (PRT) provides additional benefits to the exerciser in pursuit of fat reduction by increasing muscle mass. The increase in muscle mass uses more energy (calories) at rest. Thus, those with more muscle mass can eat more than average and maintain lower body fat. An added benefit of PRT is that increased muscle bulk in the hamstrings and gluteal region will by virtue of physics decrease the presence and appearance of cellulite. The skin and fat are "pushed away" and stretched over the increased muscle bulk resulting in smoother skin and subcutaneous fat.

Finally, there are a few outcome studies that show clear clinical improvement of cellulite after a course of massage. The challenge is that massage works best if done for at least 30 minutes every other day, and once stopped, the results fade. Massage can often become very expensive and time consuming. A device has been developed just for cellulite massage, but it requires a trained professional to operate, and is typically only available in clinics.

SUMMARY OF THE INVENTION

It has been recognized that it would be advantageous to develop an apparatus and method for reducing fat, cellulite and/or the look of cellulite.

The invention provides a resistance training and massage apparatus to simultaneously provide resistance training and massage. In an exemplary embodiment, a strap is formed into a loop to extend around a body portion of a user. The strap is displaceable as the user exerts a pulling force on the strap. A motor or vibration means is coupled to the strap to impart vibration to the strap. The motor is displaceable along with the strap as the user exerts a pulling force on the strap. A resistance means is coupled to the motor for elastically resisting displacement of the motor and the strap, and providing a resistance force to the pulling force exerted by the user.

The invention also provides a method for simultaneously performing resistance training and receiving massage. In an exemplary embodiment, a vibrating strap is looped around a body portion of a user, the strap being coupled to a motor that vibrates the strap. The user pulls against the strap and elastically displaces the strap, the strap being coupled to a resistance force to elastically resist a pulling force exerted by the user.

Additional features and advantages of the invention will be apparent from the detailed description which follows, taken in conjunction with the accompanying drawings, which together illustrate, by way of example, features of the invention.

DETAILED DESCRIPTION

Figure 1:
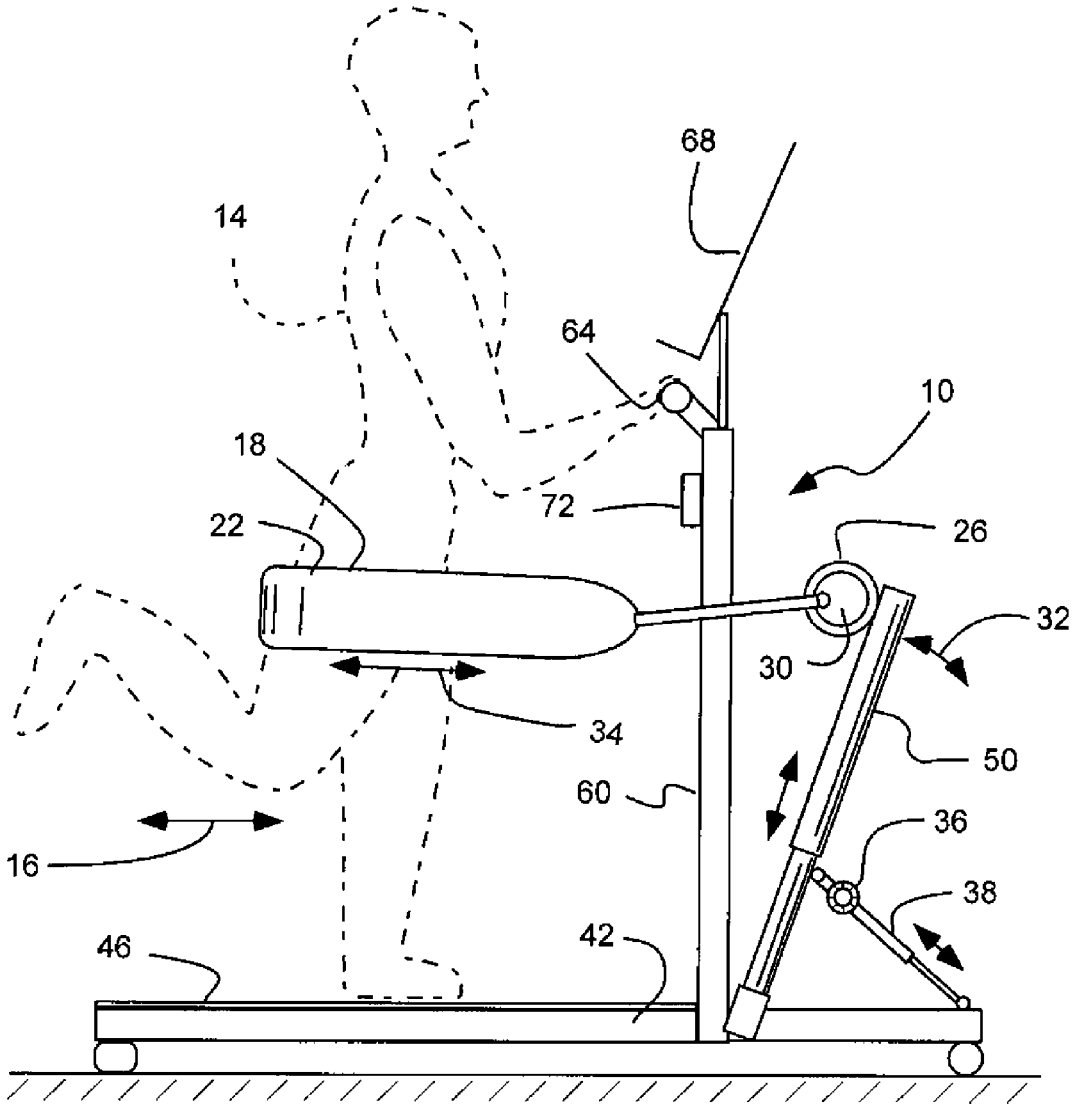
FIG. 1 is a side view of a resistance training and massage apparatus in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
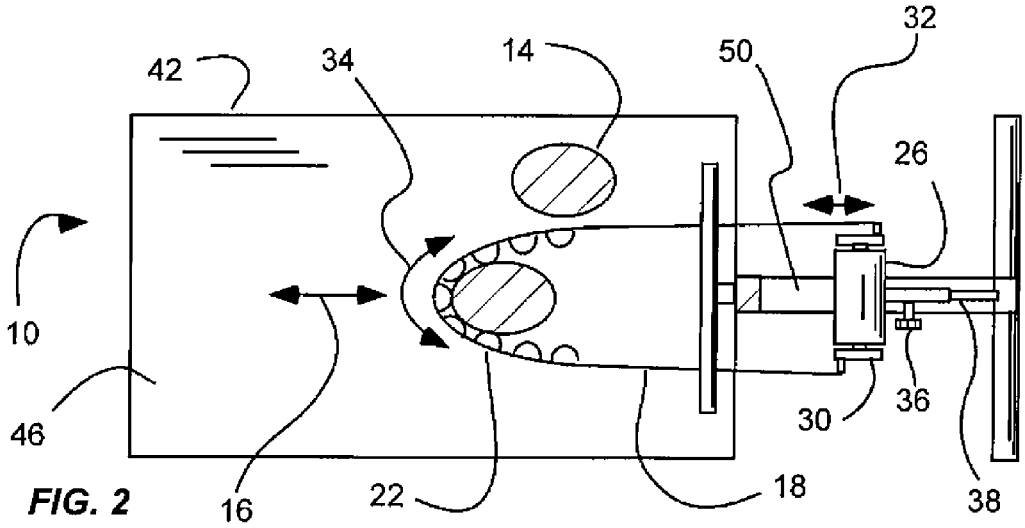
FIG. 2 is a partial cross-sectional top view of the apparatus of FIG. 1.
Figure 3:
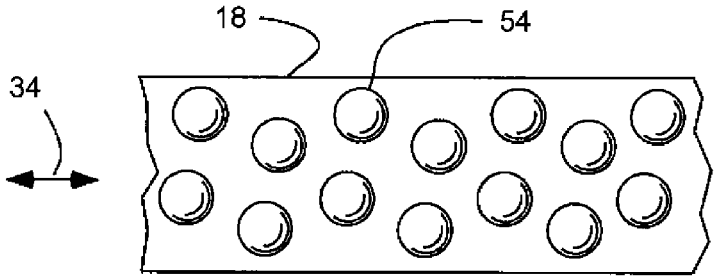
FIG. 3 is a partial side view of a strap of the apparatus of FIG. 1.

As illustrated in FIGS. 1-3, a resistance training and massage apparatus, indicated generally at 10, in accordance with the present invention is shown for simultaneously providing resistance training and massage to a user 14 in an effort to reduce cellulite, or to cosmetically alter cellulite. It is believed that progressive resistance training and massage reduce cellulite. The apparatus 10 provides "active," self administered, deep massage while training the hamstrings and gluteal muscles. It is believed that the deep massage helps to break down the septations between the fat pockets, thus eliminating the dimpled appearance of cellulite. The massage, in combination with the vibration and muscle contraction, causes dramatic increase in blood flow to the skin, subcutaneous tissue, and fat, resulting in active mobilization of fat cells. Therefore, the apparatus 10 advantageously provides both massage and resistance training simultaneously in an effort to reduce cellulite or the appearance of cellulite.

The massage is applied with a strap 18 configured to vibrate and/or oscillate a portion of the user's body, such as the user's waist, buttocks and/or thighs. The strap 18 can be formed into a loop 22 extending around the user's body portion. For example, the loop 22 can extend around the user's thigh, as shown in FIG. 1. The terms "vibrate" and "oscillate" are used interchangeably herein to refer broadly to movement of the strap 18, including vibration, oscillation, etc. A motor 26 can be operatively coupled to the strap 18 to vibrate and/or oscillate the strap. The strap 18 can be elongated and can have distal ends. The motor 26 can have dual shafts with flywheels 30 disposed on both shafts. The distal ends of the strap can be coupled to opposite flywheels 30, and to opposite eccentric positions on the flywheels 30. Thus, as the motor 26 rotates, the strap is caused to oscillate, as indicated by arrow 34. The motor 26 can be an electrical motor with variable speeds. The motor 26 is one example of vibration means for imparting vibration to the strap. Other vibration means can include, for example, motors with off-balance shafts or weights, linear motors, etc.

Figure 1B:
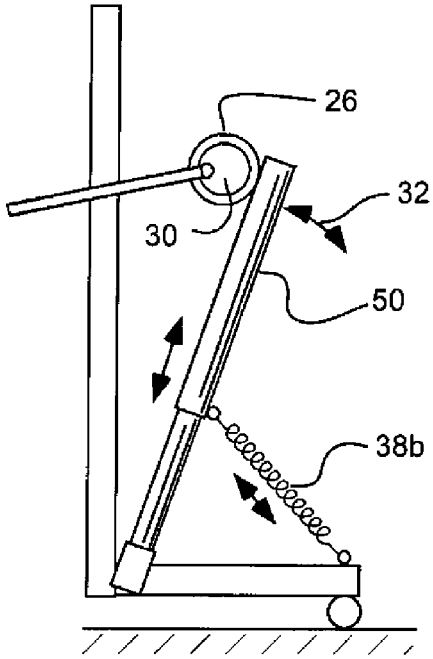
FIG. 1*b* is a partial side view of another resistance training and massage apparatus in accordance with an embodiment of the present invention.
Figure 1C:
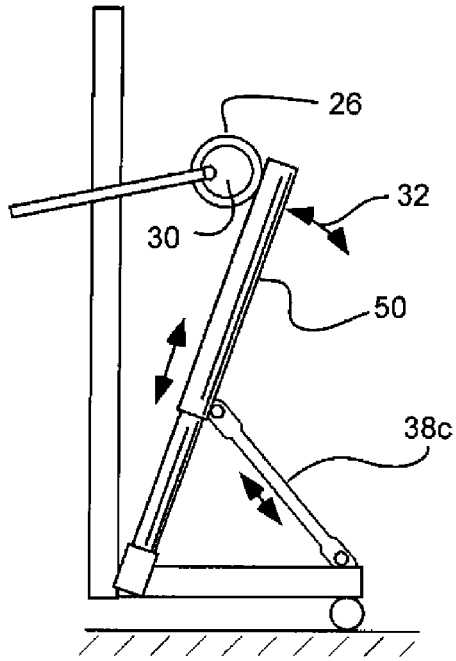
FIG. 1*c* is a partial side view of another resistance training and massage apparatus in accordance with an embodiment of the present invention.
Figure 1D:
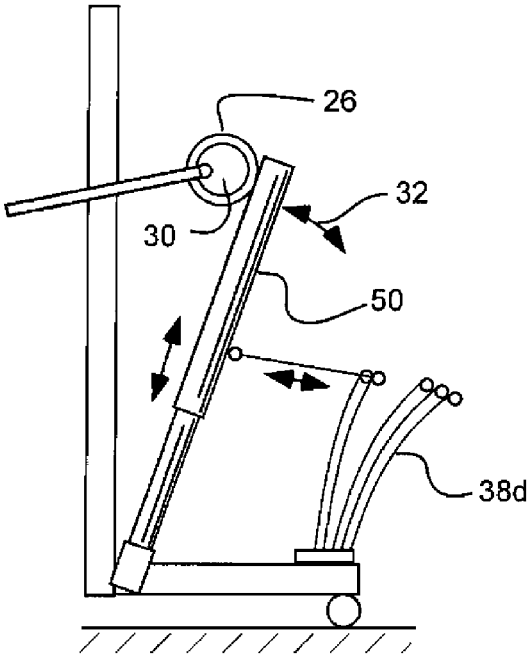
FIG. 1*d* is a partial side view of another resistance training and massage apparatus in accordance with an embodiment of the present invention.

The resistance training is provided by elastically displacing the strap 18. Thus, the strap 18 is horizontally displaceable over a range of several inches as the user 14 repeatedly exerts a pulling force 16 on the strap. For example, the strap or loop can extend around the user's leg or thigh, and the user can repeatedly pull the strap backwardly or rearwardly, as shown in FIGS. 1 and 2. The motor 26 also can be displaceable more than several inches (as indicated by 32 in FIGS. 1 and 2) along with the strap as the user exerts the pulling force 16 on the strap. A resistance force is provided to the pulling force of the user. The resistance force can be provided by a gas shock 38 coupled to the motor. The gas shock 38 can include a piston movably disposed in a cylinder to define a chamber therein. As the piston is drawn away from the chamber, the volume decreases and creates a negative pressure that resists displacement of the piston. The gas shock 38 is one example of a resistance means for elastically resisting displacement of the motor and the strap, and providing a resistance force to the pulling force exerted by the user. Other resistance means can include, for example, coil springs (38*b* in FIG. 1*b*), leaf springs, elastic members (38*c* in FIG. 1*c*), air shocks, weights, etc. In addition, the resistance means can be adjustable for providing a variable resistance force to the pulling force exerted by the user. For example, the resistance force can be adjusted by adjustable valves for air shocks 36, adjustable couplings of springs or elastic members (36*c* in FIG. 1*c*), or pulley systems for weights, etc. Furthermore, the strap 18 can include an elastic strap capable of elastic deformation as the user exerts a pulling force. The strap 18 itself can be elastic, or a portion of the strap 18 can include an elastic portion.

Therefore, the motor 26 and the strap 18 can provide massage simultaneously while the user performs resistance training by repeatedly pulling 16 against the resistance means and relaxing the strap.

The apparatus 10 can include a base 42 with a platform 46 to support the user 14. An arm 50 can be movably or pivotally coupled to the base 42, and can carry the motor 26. A first end of the arm 50 can be pivotally coupled to the base 42, while the motor can be mounted to a second end of the arm. The gas shock 38 or resistance means can be coupled between the base and the arm. The position(s) of the connection between the gas shock and the arm 50 and/or base 42 can be moved or adjusted to change the resistance force provided by the gas shock.

The arm 50 can have an adjustable length to change or adjust an elevation of the motor 26. Thus, the elevation of the strap 18 can be adjusted to suit the user's body, and/or position the strap where needed. For example, the arm 50 can include first and second portions movably coupled together, or telescoping portions. The two portions can be selectively fixed with respect to one another by a pin selectively disposable in an array of apertures in the portions.

An elevational height of the strap 18 and the motor 26 can be adjusted to correspond to the waist, buttocks or thigh of the user 14.

The base or frame 42 and vertical column 60 can be formed of metal, such as tubular steel or aluminum cut or bent to form the desired shape, and welded together or to other components. The platform 46 can be metal or plastic, and can include a non-skid or non-slip surface. It is of course understood that the base or frame can have other configurations. The arm 50 can be formed of telescoping steel or aluminum tubes, and can be adjustable by a series of holes and a locking pin. The resistance means can be coupled to the arm and/or base by a pin inserted through apertures in brackets and the resistance means and the base. The resistance means can be adjustably coupled by using a series of apertures.

Referring to FIG. 3, the strap 18 can include a plurality of protrusions 54 extending inwardly with respect to the loop 22. The protrusions 54 can help provide a deeper massage by creating concentration points for the force and vibration against the user's body. The protrusions 54 can be flexible and resilient.

Figure 4:
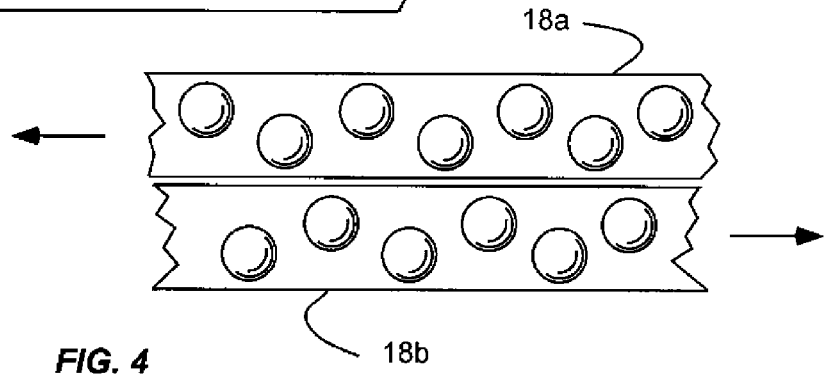
FIG. 4 is a partial side view of another strap in accordance with an embodiment of the present invention.
Figure 5:
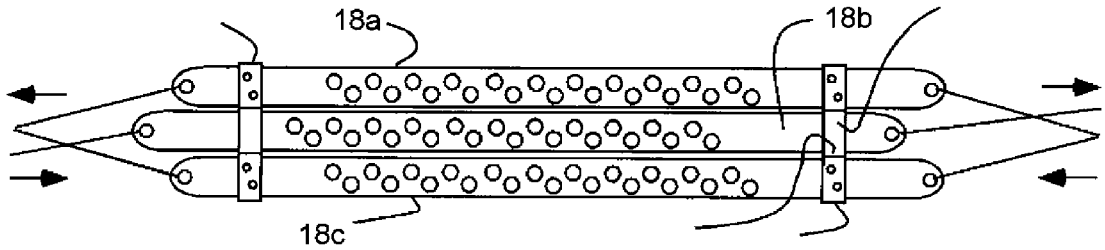
FIG. 5 is front view of another strap in accordance with an embodiment of the present invention.
Figure 6:
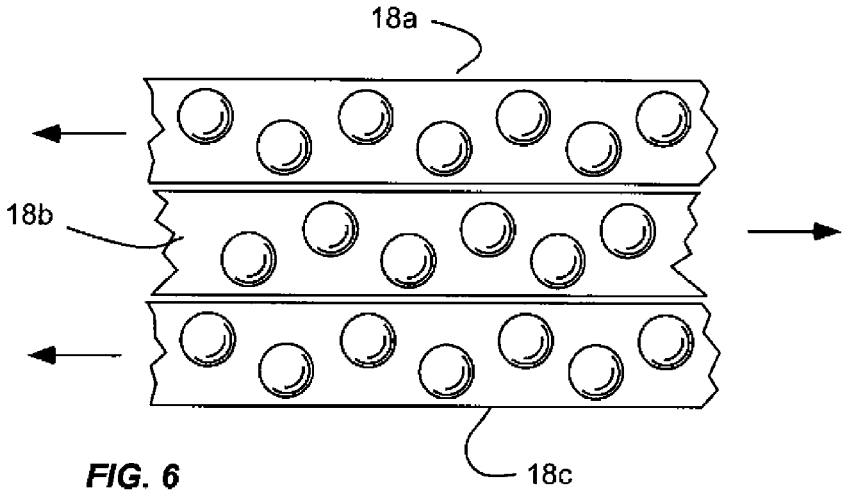
FIG. 6 is a partial front view of the strap of FIG. 5.
Figure 7:
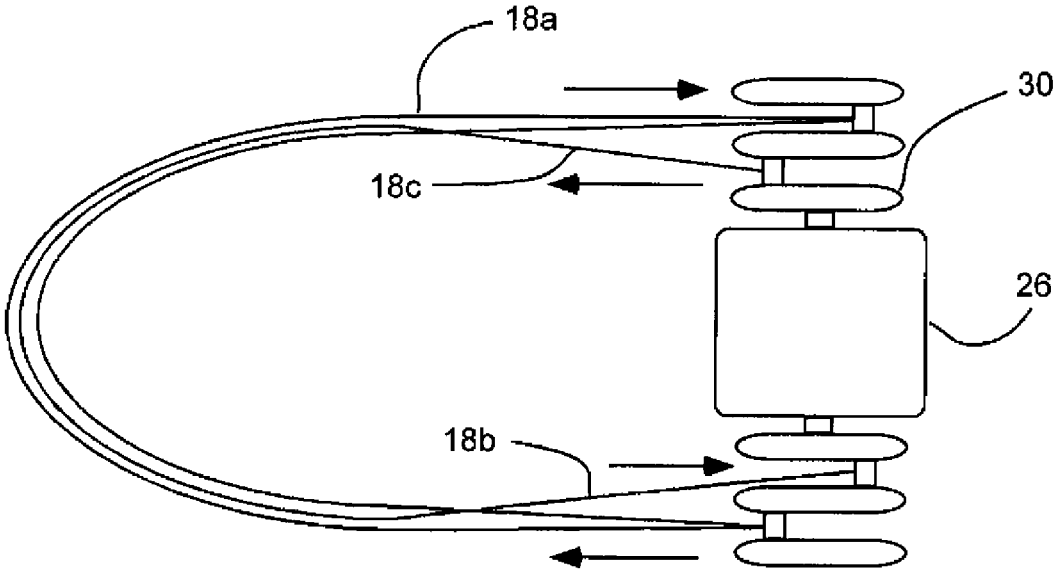
FIG. 7 is a top schematic view of the strap of FIG. 5.

Referring to FIG. 4, another strap is shown that includes two straps 18*a* and 18*b* that move or oscillate in different directions, or in opposite directions of one another. Referring to FIGS. 5 and 6, another strap is shown that includes three straps 18*a*, 18*b* and 18*c*. The upper and lower straps 18*a* and 18*c* can move in the same direction, while the middle strap 18*b* moves opposite to the other straps. The opposite movement of the straps can provide a more invigorating massage. The opposite motion can be obtained by coupling the corresponding ends of the straps to different locations on the flywheels 30 having opposing eccentricities, as shown schematically in FIG. 7. The flywheels 30 can include dual flywheels on each side of the motor, each wheel of the dual flywheel having a different connection point with opposing eccentricities for the strap. Thus, as the flywheel rotates, the straps move in different directions.

The base 42 can include a vertical column 60 with a grip or handle 64 to allow the user to stabilize himself or herself. A stand 68 can be disposed on the column 60 to receive a book, magazine, television screen or monitor, etc. A timer 72 can also be carried by the column to allow the user to time the exercise and massage.

Figure 8:
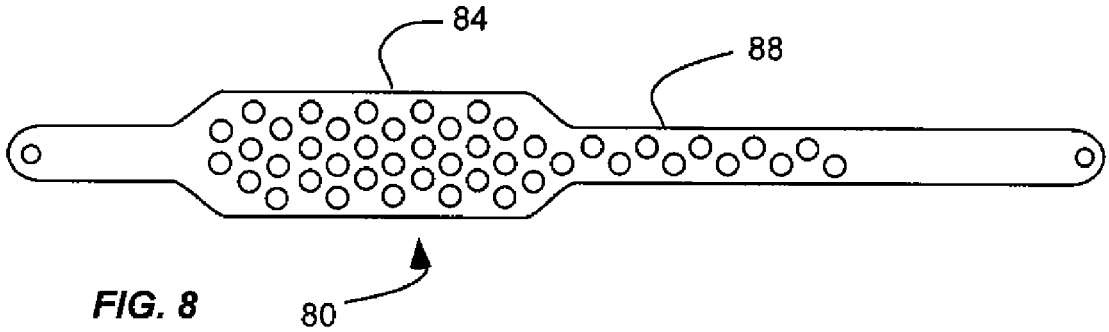
FIG. 8 is a front view of another strap in accordance with an embodiment of the present invention.
Figure 9:
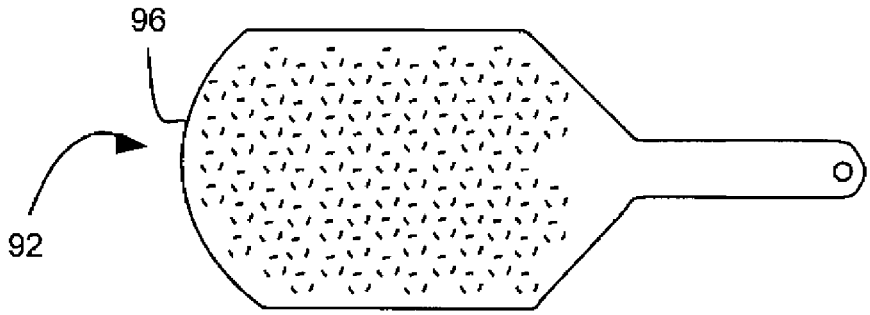
FIG. 9 is a side view of another strap in accordance with an embodiment of the present invention.

Different straps can be provided that are configured or shaped for different parts of the body. For example, a thigh strap 80 can have a wider or taller section 84 on one side, and a narrower or shorter section 88 on the other side, as shown in FIG. 8. Thus, the narrower or shorter section 88 can be positioned between the user's leg without causing undue discomfort, while the wider or taller section 84 can cover a greater surface of the user's skin on the back, outside and/or front of the user's thigh or hip. In another example shown in FIG. 9, a buttocks strap 92 can have a curved or cupped portion 96 configured to receive the user's buttocks therein, and maximize coverage of the user's buttocks.

Figure 10:
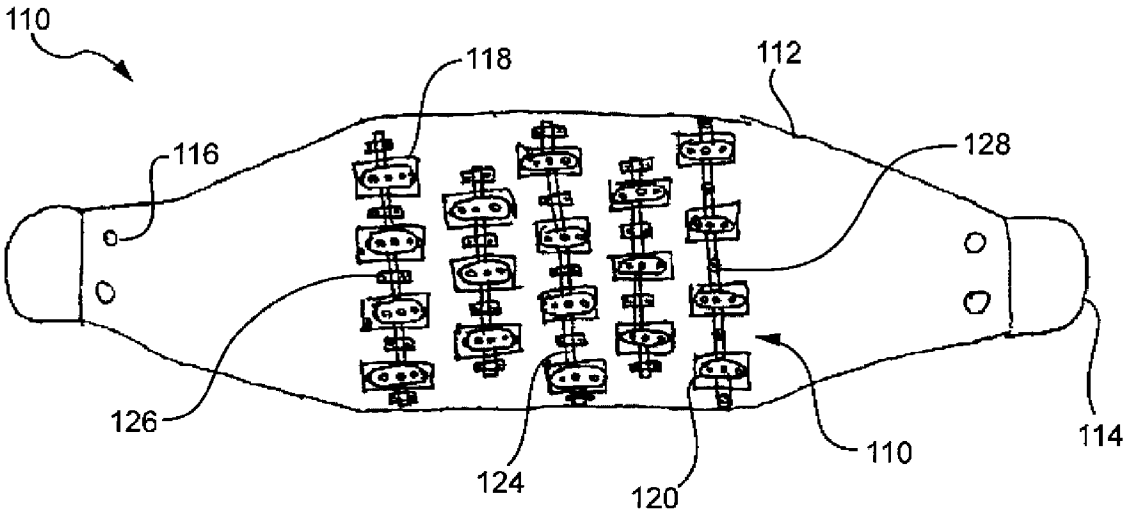
FIG. 10 is a front view of another strap in accordance with an embodiment of the present invention.
Figure 11:
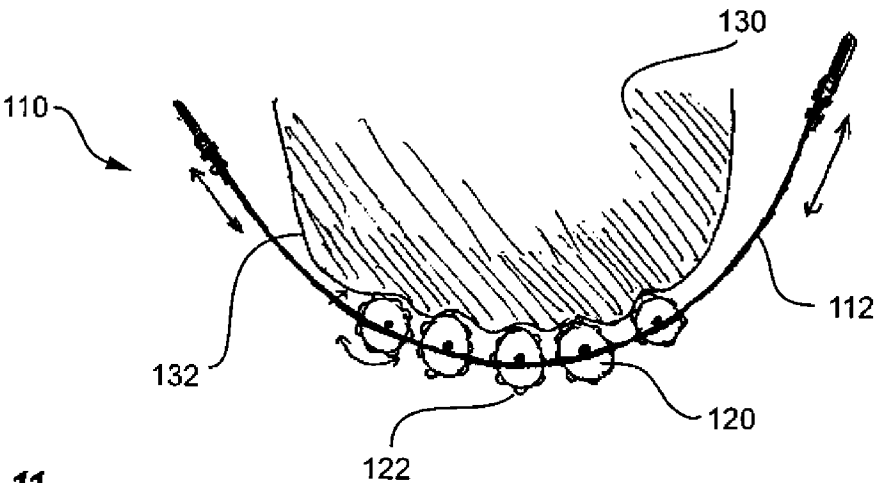
FIG. 11 is a top schematic view of the strap of FIG. 10.

FIGS. 10 and 11 are front and top views of yet another strap 110 in accordance with an exemplary embodiment of the present invention. The strap 110 can have features common with the straps previously discussed hereinabove, namely a strap body 112 having eyelets 114 coupled to either end for attachment to the vibration source or motor. The eyelets 114 can be attached to the strap body 112 with fasteners 116, such as rivets or bolts or screws. Unlike the other embodiments, however, the strap 110 can also support a plurality of freely-moving wheels 120 that provide a deep, vibrating massage to a body portion 130 of a user, such as an upper thigh, while helping prevent chafing of the skin 132 through the rolling contact of the wheels.

The wheels 120 can be supported on the strap 110 with axles 124 attached to the belt or strap body 112 with anchors 126, screws 128 or other similar methods of attachment. Slots or holes 118 can also be formed in the strap body 112 which allow the wheels to extend out the backside of the strap and the supporting axles to be mounted flush against the interior surface of the strap body 112. The axles 124 can be stationary, and each wheel 120 can be provided with a bearing or bushing to permit rotation independent from the other wheels. The wheels 120 can also be provided with small knobs 122 which act to deepen the massage and further break down the fatty cellulite tissue in the targeted body portion.

Figure 12:
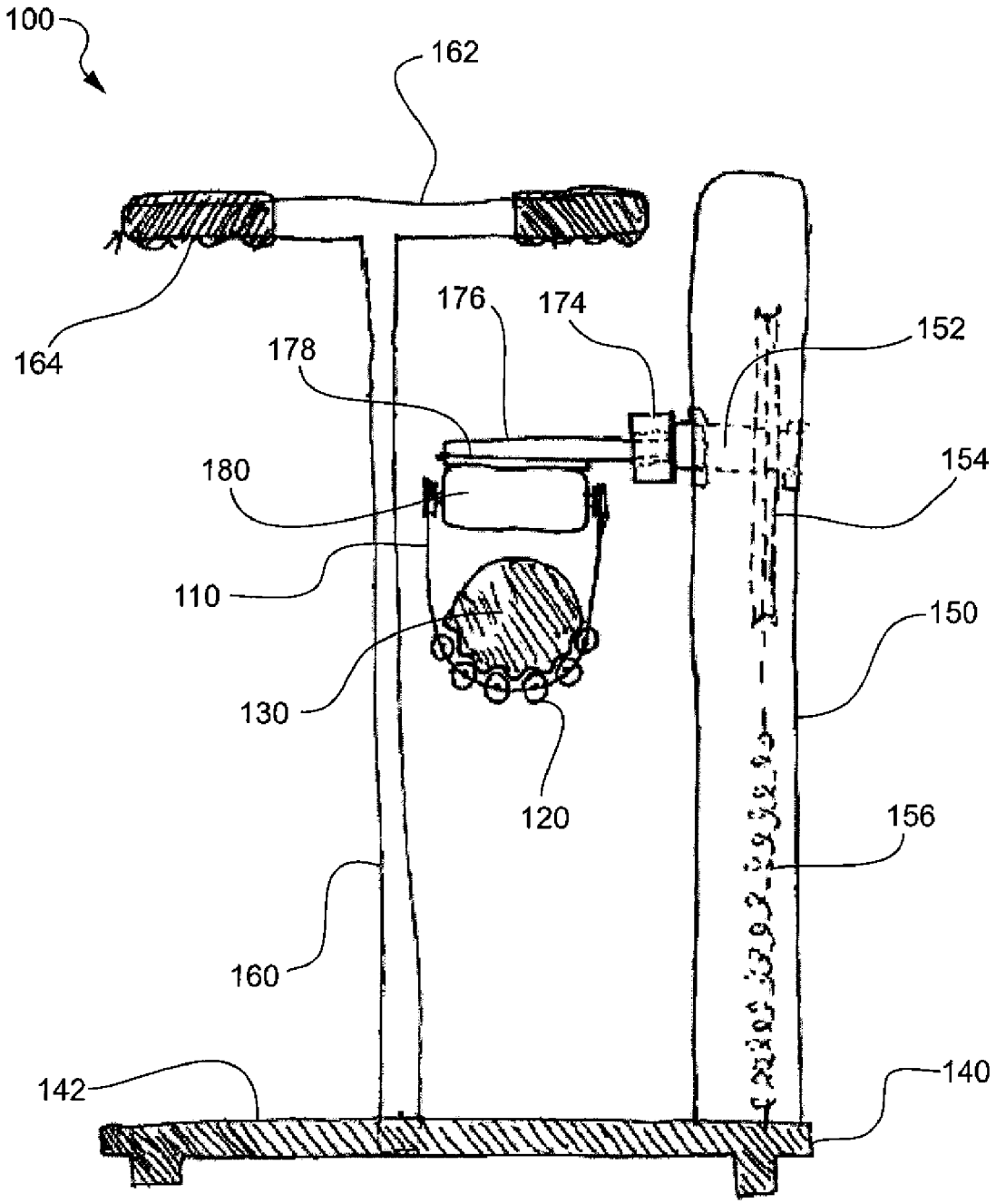
FIG. 12 is a front view of a resistance training and massage apparatus in accordance with another embodiment of the present invention.
Figure 13:
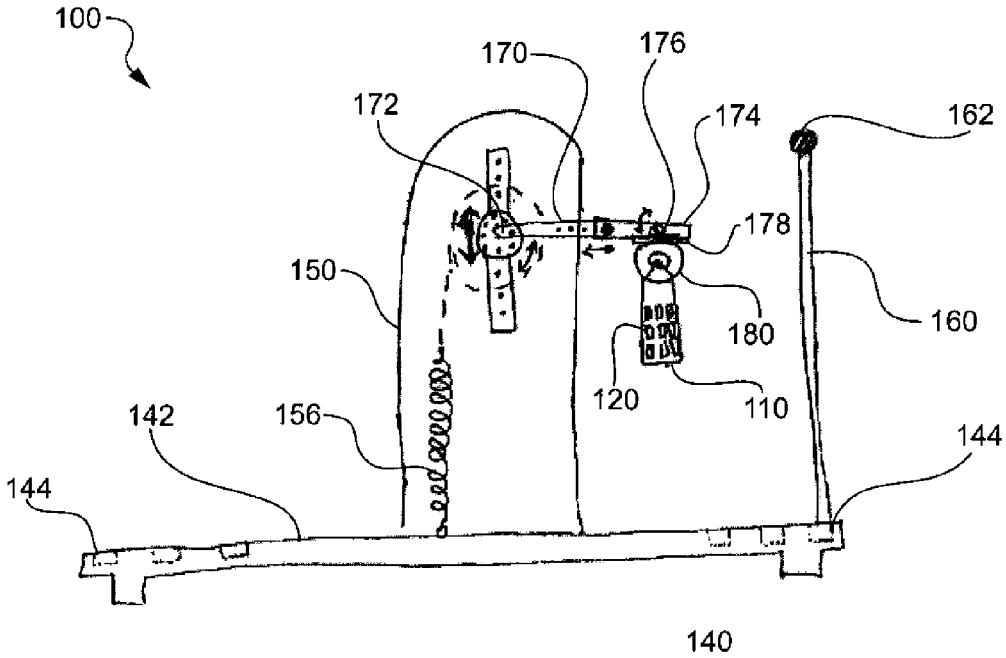
FIG. 13 is a side view of the resistance training and massage apparatus of FIG. 12.
Figure 14:
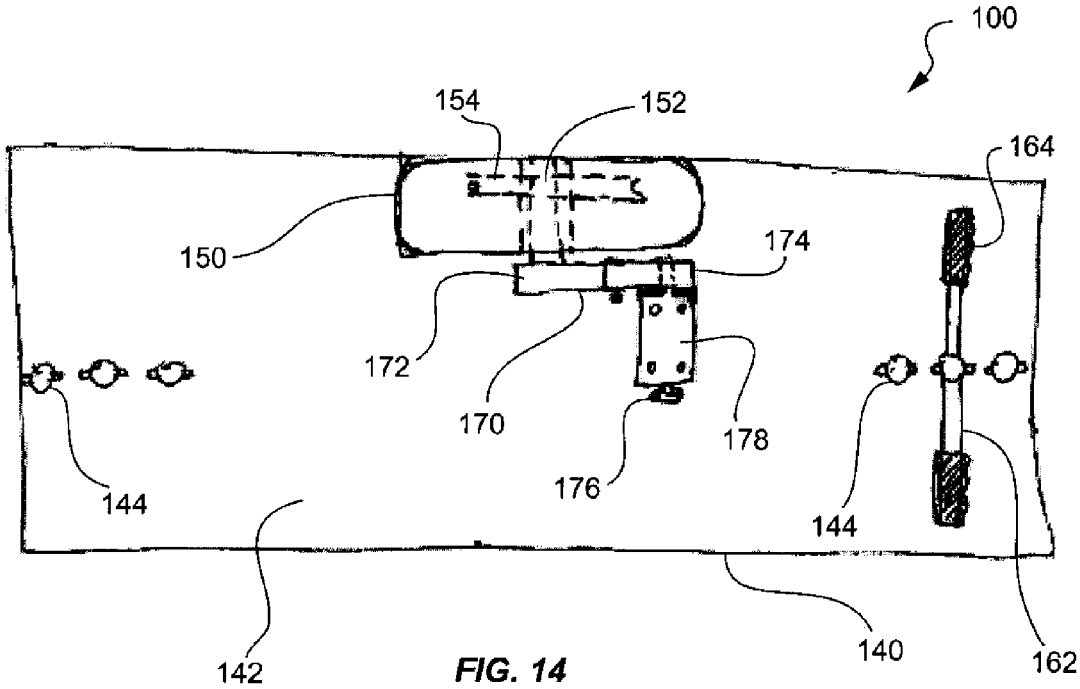
FIG. 14 is a top view of the resistance training and massage apparatus of FIG. 12.

FIGS. 12, 13 and 14 together illustrate the front, side and top views of a resistance training and massage apparatus 100 in accordance with another embodiment of the present invention. In this embodiment the user can stand on the top surface 142 of a support base 140, to which is connected a resistance tower 150 that supports the massage and resistance training mechanism, and a vertical handlebar column 160 that can help stabilize the user performing the exercise. The handlebar column 160 can have a top crosspiece or handlebar 162 with handlebar grips 164. While the resistance tower 150 can be fixed to one side of the support base, the handlebar column can be reversible end-to-end to allow the user to work both sides of the body. Handlebar column receptacles 144 can be formed at multiple locations at either end of the support base 140 for a personalized configuration that can be tailored to the sizes and shapes of the various users.

Figure 1E:
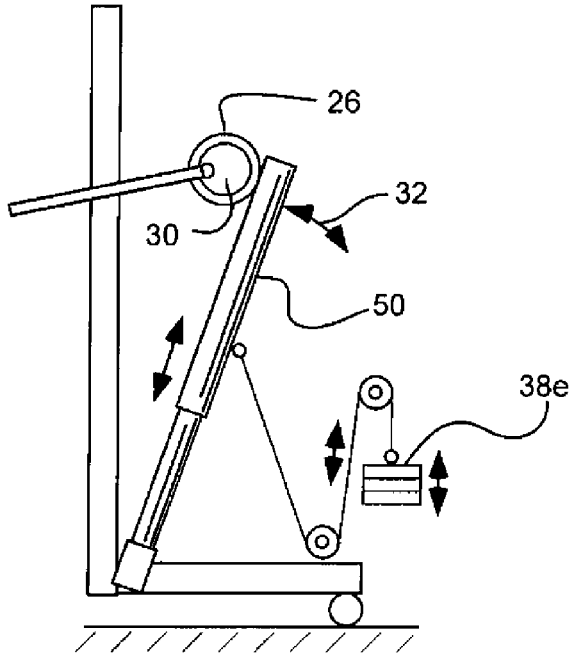
FIG. 1*e* is a partial side view of another resistance training and massage apparatus in accordance with an embodiment of the present invention.

The resistance tower 150 can extend upwards from one side of the support base 140 to support a resistance axle 152 near the waist height of the user. The resistance axle 152 is height adjustable, and can be moved upwards or downwards to align the pivot point of the resistance exercise at or above the level of the waist or hips of the user. Furthermore, a resistance source or means can be coupled to the resistance axle, which in the embodiment shown in FIGS. 12-14 is a load cam 154 connected to a coil spring 156 for elastically resisting rotation of the load cam 154 and resistance axle 152. Other resistance means, previously described and illustrated in FIGS. 1-1*e*, can be coupled to the resistance axle to elastically resist its rotation, including gas shocks, air shocks, leaf springs, elastic members, weights, etc. As the resistance and massage training apparatus is reversible to allow the user to train both sides of the body, the resistance means can also be configured to resist rotation of the resistance axle in either direction.

A lever arm 170 having a pivot end 172 and a free end 174 can be coupled to the resistance axle at the pivot end 172. The lever arm 170 can be configured so that the free end 174 extends forward toward the handlebar column 160, and can be both length adjustable and reversible to accommodate the overall reversibility and adjustability of the resistance and massage training apparatus. Coupled to the free end 174 of the lever arm is the vibration source or motor 180, which can be mounted on a swivel arm 176 that can be orientated at an angle extending inward toward the center of the training apparatus and substantially orthogonal to the lever 170 arm. The motor 180 can be coupled to a flattened anchor plate 178, which in turn can be attached to the swivel arm 176. The swivel arm 176 can be coupled to the lever arm 170 by way of a bearing or bushing which allows the swivel arm to rotate relative to the lever arm under the influence of gravity or the exercising user, so that the motor 180 can hang below the axis of the swivel arm regardless of which direction the user is facing.

As shown in FIG. 12, the massaging belt or strap 110 can be looped around a body portion of the user targeted for concentrated exercise, such as an upper thigh 130, and attached at both ends to the motor 180 such that the inside surface of the strap 110 forms a contact surface contacting the body portion. If the strap has rollers or wheels 120 (see FIGS. 12, 13), the wheels may press into the tissue adjacent the contact surface for greater contact. Activating the motor 180 can cause the strap 100 to vibrate back and both against the bottom half of the user's upper thigh 130 and create a massaging effect. If the user then pulls downward and backward against the strap 110, it is to be appreciated that the resulting force is transferred, in turn, through the strap 110, motor 180, anchor plate 178, swivel arm 176, lever arm 170, and resistance axle 152, and ultimately to the resistance source 154, 156 enclosed within the resistance tower 150.

The resistance source can be configured to elastically resist the rotation of the resistance axle 152 and lever arm 170, and the corresponding displacement of the swivel arm 176, motor 180 and strap 110, thus providing a resistance force to the pulling force exerted by the user. This resistance can provide the desirable progressive resistance training effect, while simultaneously causing the wheels 120 to dig deeper into the tissue of the body portion 130 to provide a deeper massaging effect and better reduce cellulite.

It is to be appreciated that the scope of the present invention can include embodiments which do not require a strap or belt. For instance, in an exemplary embodiment a motor or vibration means can be coupled to a padded massage roller, that is in turn connected to a resistance means that resists a pushing force, rather than a pulling force, exerted by the user. The resistance force can be both progressive and adjustable. The user can push against the massage roller with a body portion such as a leg, arm or part of a torso. As the user exerts a pushing force on the roller, the motor or vibration means is displaceable along with the massage roller to simultaneously provides both resistance training and massage to the body portion of the user contacting the roller. Another exemplary embodiment can include a method of pushing a body portion against a vibrating massage roller, the roller being coupled to a resistance force to elastically resist the pushing force exerted by the user.

Figure 15:
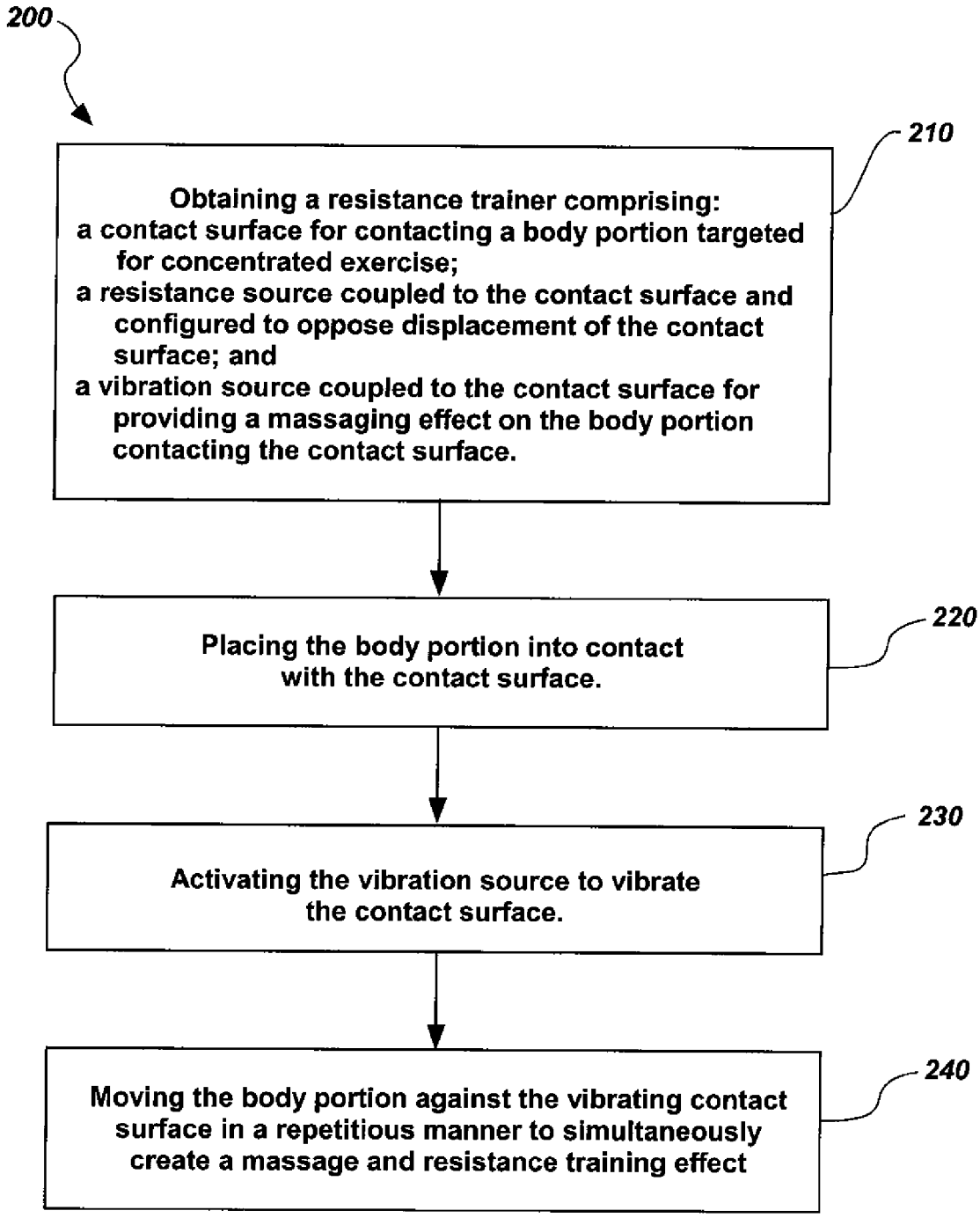
FIG. 15 is a flowchart depicting a method of concentrated exercise on a targeted body portion of a user.

Illustrated in FIG. 15 is a flowchart depicting a method 200 of concentrated exercise on a targeted body portion of a user, according to an exemplary embodiment of the present invention. The method can include the operation of obtaining 210 a resistance trainer comprising a contact surface for contacting a body portion targeted for concentrated exercise, a resistance source coupled to the contact surface for generating a resistive force that opposes the displacement of the contact surface, and a vibration source coupled to the contact surface for providing a massaging effect on the body portion contacting the contact surface. The method can also include the steps of placing 220 the body portion into contact with the contact surface, activating 230 the vibration source to vibrate the contact surface, and moving 240 the body portion against the vibrating contact surface in a repetitious manner to create a simultaneous massage and resistance training effect.

Figure 16:
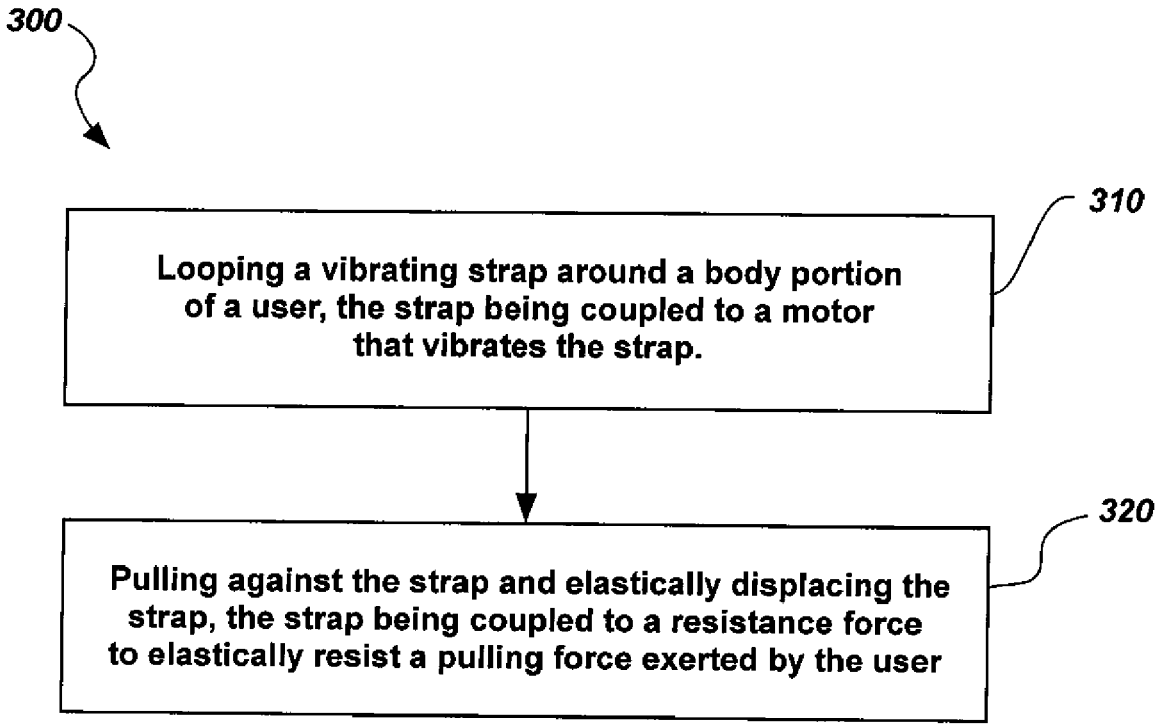
FIG. 16 is a flowchart depicting a method for simultaneously providing resistance training and massage.

A flowchart depicting an exemplary method 300 for simultaneously performing resistance training and receiving massage, according to another exemplary embodiment of the present invention, is shown in FIG. 16. The method 300 can include the step of looping 310 a vibrating strap around a body portion of the user, with the strap being coupled to the motor to vibrate the strap. The strap can be looped around the waist, buttocks or thigh of the user. The method further includes the step of pulling 320 against the strap and elastically displacing the strap, with the strap being coupled to a resistance force to elastically resist the pulling force exerted by the user. The user can repeatedly pull against the strap, and relax the strap to create a resistance training effect. Moreover, the user can implement an exercise/massage regimen that includes regular use of the apparatus. For example, the user can exercise/massage for 20-30 minutes a day, 3-5 times a week.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed and desired to be secured by Letters Patent is:

1. A method for simultaneously performing resistance training and receiving massage, comprising the steps of:

a) looping a vibrating strap around a body portion of a user, the strap being coupled to a motor that vibrates the strap; and b) pulling against the strap and elastically displacing the strap, the strap being coupled to a resistance axle, disposed on a support base, that is coupled to a resistance source to elastically resist rotation of the resistance axle and to elastically resist a pulling force exerted by the user wherein vibration of the strap and pulling against the strap results in muscle contraction and reduction of fat, cellulite or appearance of cellulite.

2. A method in accordance with claim 1, further comprising the step of: adjusting an elevational height of the strap and the motor to correspond to the waist, buttocks or thigh of the user.

3. A method in accordance with claim 1, wherein the step of looping a strap around a body portion of a user further includes looping the strap around the waist, buttocks or thigh of the user.

4. A method in accordance with claim 1, wherein the step of pulling further includes repeatedly pulling and relaxing the strap.

5. A method in accordance with claim 1, further comprising the step of:

disposing the user on a platform of the base with the base supporting the resistance axle and with a lever arm coupled between the resistance axle and the strap.

6. A method in accordance with claim 1, wherein the pulling against the strap displaces the strap and the motor together.

7. A method for simultaneously providing resistance training and massage, comprising the steps of:

a) looping a strap around a body portion of a user;

b) pulling against the strap coupled to a lever arm coupled to a resistance axle, disposed on a base, that is coupled to a resistance source to elastically resist rotation of the resistance axle;

c) displacing the strap in response to the pulling; and d) causing the strap to vibrate with a vibration source coupled to the strap simultaneously while pulling on the strap wherein vibration of the strap and pulling against the strap results in muscle contraction and reduction of fat, cellulite or appearance of cellulite.

8. A method in accordance with claim 7, further comprising the step of:

adjusting an elevational height of the strap and the vibration source to correspond to the waist, buttocks or thigh of the user.

9. A method in accordance with claim 7, wherein the step of looping a strap around a body portion of a user further includes looping the strap around the waist, buttocks or thigh of the user.

10. A method in accordance with claim 7, wherein the step of pulling further includes repeatedly pulling and relaxing the strap.

11. A method in accordance with claim 7, wherein the pulling against the strap displaces the strap and the vibration source together.

12. A method of concentrated exercise on a targeted body portion of a user, comprising:

obtaining a resistance trainer comprising:

a strap with an interior surface for contacting a body portion targeted for concentrated exercise, the strap being coupled to a resistance axle disposed on a base;

a resistance source coupled to the strap for generating a resistive force configured to oppose rotation of the resistance axle and displacement of the strap; and a vibration source coupled to the strap for providing a massaging effect on the body portion contacting the interior surface;

adjusting an initial value of the resistive force;

placing the body portion into contact with the interior surface;

activating the vibration source to vibrate the strap; and moving the body portion against the vibrating strap in a repetitious manner to create a simultaneous massage and resistance training effect wherein vibration of the strap and moving the body portion against the strap results in muscle contraction and reduction of fat, cellulite or appearance of cellulite.

13. The method of claim 12, wherein obtaining a resistance trainer further comprises configuring the resistance source to generate a constant resistive force during the displacement of the interior surface.

14. The method of claim 12, wherein obtaining a resistance trainer further comprises configuring the resistance source to generate an increasing resistive force during the displacement of the interior surface.

15. The method of claim 12, wherein obtaining a resistance trainer further comprises configuring the vibration source coupled to the strap as a motor coupled to the strap.

16. The method of claim 15, wherein moving the body portion against the strap in a repetitious manner further comprises repeatedly pulling and relaxing the strap.

17. The method of claim 12, further comprising the step of:

disposing the user on a supporting surface of the resistance trainer, wherein the supporting surface is coupled to a resistance tower having a lever arm, wherein a pivot end of the lever arm is coupled to the resistance tower and a free end of the lever arm is coupled to the vibration source, and resistance means within the resistance tower for elastically resisting rotation of the lever arm and the strap.

18. The method of claim 12 wherein the resistance source provides elastic resistance to rotation of the resistance axle.

19. The method of claim 12 wherein the resistance source provides elastic resistance to rotation of the resistance axle, and the strap is coupled to the resistance axle by a lever arm.

* * * * *